US011371105B2

(12) United States Patent
Pilote et al.

(10) Patent No.: US 11,371,105 B2
(45) Date of Patent: Jun. 28, 2022

(54) SMELTING PROCESS AND APPARATUS

(71) Applicant: TATA STEEL LIMITED, Mumbai (IN)

(72) Inventors: Jacques Pilote, Woodlands (AU); Rodney James Dry, City Beach (AU)

(73) Assignee: TATA STEEL LIMITED, Mumbai (IN)

( * ) Notice: Subject to any disclaimer, the term of this patent is extended or adjusted under 35 U.S.C. 154(b) by 820 days.

(21) Appl. No.: 16/098,744

(22) PCT Filed: May 2, 2017

(86) PCT No.: PCT/AU2017/050400
§ 371 (c)(1),
(2) Date: Nov. 2, 2018

(87) PCT Pub. No.: WO2017/190185
PCT Pub. Date: Nov. 9, 2017

(65) Prior Publication Data

US 2019/0136333 A1 May 9, 2019

(30) Foreign Application Priority Data

May 2, 2016 (AU) ..... 2016901601

(51) Int. Cl.
*C21B 7/10* (2006.01)
*C21B 7/06* (2006.01)
(Continued)

(52) U.S. Cl.
CPC ..... *C21B 7/10* (2013.01); *C21B 7/06* (2013.01); *C21B 7/12* (2013.01); *F27B 3/24* (2013.01);
(Continued)

(58) Field of Classification Search
None
See application file for complete search history.

(56) References Cited

U.S. PATENT DOCUMENTS 4,573,524 A * 3/1986 Kotaka ..... F28D 15/0266 165/96
5,379,831 A 1/1995 Carpenter
(Continued)

FOREIGN PATENT DOCUMENTS

WO WO 00/01854 1/2000
WO WO 00/22176 4/2000
(Continued)

OTHER PUBLICATIONS

International Search Report and Written Opinion, International Patent Application No. PCT/AU2017/050400, dated Aug. 15, 2017 (8 pages).
(Continued)

*Primary Examiner* — Scott R Kastler
(74) *Attorney, Agent, or Firm* — Hamre, Schumann, Mueller & Larson, P.C.

(57) ABSTRACT

A smelting vessel includes a plurality of heat pipes (21) positioned in a refractory lining of at least a part of the hearth (9) for cooling at least a part of the refractory lining. At least one of the heat pipes includes (a) a liquid phase of a heat
(Continued)

transfer fluid, typically water, in a lower section of the heat pipe and (b) a vapor phase of the heat transfer fluid, typically steam, in an upper section of the heat pipe. The heat pipe also includes a vent to allow vapour phase to escape from the heat pipe to reduce the pressure or the temperature within the heat pipe when the vapour pressure or the temperature in the heat pipe exceeds a predetermined threshold pressure or temperature.

12 Claims, 4 Drawing Sheets

(51) Int. Cl.

| | |
|---|---|
| ***F27B 14/00*** | (2006.01) |
| ***F27D 1/12*** | (2006.01) |
| ***F27B 3/24*** | (2006.01) |
| ***C21B 7/12*** | (2006.01) |
| ***F28D 15/02*** | (2006.01) |
| *C21C 5/46* | (2006.01) |
| *F27B 14/08* | (2006.01) |
| *F27B 14/10* | (2006.01) |

(52) U.S. Cl.
CPC ..... *F27D 1/12* (2013.01); *F28D 15/0275* (2013.01); *C21B 7/106* (2013.01); *C21C 5/4646* (2013.01); *F27B 2014/002* (2013.01); *F27B 2014/0837* (2013.01); *F27B 2014/104* (2013.01)

(56) References Cited

U.S. PATENT DOCUMENTS

| | | | | |
|---|---|---|---|---|
| 10,451,348 | B2 * | 10/2019 | Davis | C21C 5/5241 |
| 2008/0111287 | A1 | 5/2008 | Pyne | |
| 2015/0084246 | A1 * | 3/2015 | Tang | F27D 9/00 266/46 |
| 2019/0136333 | A1 * | 5/2019 | Pilote | C21B 7/10 |

FOREIGN PATENT DOCUMENTS

| | | |
|---|---|---|
| WO | WO 2007/134382 | 11/2007 |
| WO | 2015/081376 | 6/2015 |

OTHER PUBLICATIONS

International Preliminary Report on Patentability, International Patent Application No. PCT/AU2017/050400, dated Jun. 13, 2018 (17 pages).

* cited by examiner

SMELTING PROCESS AND APPARATUS

TECHNICAL FIELD

The present invention relates to a process and an apparatus for direct smelting a metalliferous material such as an iron-containing material (such as an iron ore) or a titania slag or a copper-containing material.

The present invention relates particularly to smelting a metalliferous material in a direct smelting vessel that contains a molten bath having a molten metal layer and a molten slag layer and has a refractory material-lined hearth that requires cooling to maximise the operational life of the hearth. The present invention relates particularly to cooling the refractory material-lined hearth of the direct smelting vessel to maximise the operational life of the hearth.

BACKGROUND

There are a number of known molten bath-based smelting processes.

One molten bath-based smelting process that is generally referred to as the "HIsmelt" process is described in a considerable number of patents and patent applications in the name of the applicant.

Another molten bath-based smelting process is referred to hereinafter as the "HIsarna" process. The HIsarna process and apparatus are described in International application PCT/AU99/00884 (WO 00/022176) in the name of the applicant.

Other known molten bath-based smelting processes include by way of example only, processes for smelting titania slag and for smelting copper-containing material.

The following description of the invention focuses on the HIsmelt and the HIsarna processes.

The HIsmelt and the HIsarna processes are associated particularly with producing molten iron from iron ore or another iron-containing material.

In the context of producing molten iron, the HIsmelt process includes the steps of:

(a) forming a bath of molten iron and molten slag in a smelting chamber of a smelting vessel;

(b) injecting into the bath: (i) iron ore, typically in the form of fines; and (ii) a solid carbonaceous material, typically coal, which acts as a reductant of the iron ore feed material and a source of energy; and (c) smelting iron ore to iron in the bath.

The term "smelting" is herein understood to mean thermal processing wherein chemical reactions that reduce metal oxides take place to produce molten metal.

The HIsmelt process enables large quantities of molten iron, typically at least 0.5 Mt/a, to be produced by smelting in a single compact vessel.

The HIsarna process is carried out in a smelting apparatus that includes (a) a smelting vessel that includes a smelting chamber and lances for injecting solid feed materials and oxygen-containing gas into the smelting chamber and is adapted to contain a bath of molten metal and slag and (b) a smelt cyclone for pre-treating a metalliferous feed material that is positioned above and communicates directly with the smelting vessel.

The term "smelt cyclone" is understood herein to mean a vessel that typically defines a vertical cylindrical chamber and is constructed so that feed materials supplied to the chamber move in a path around a vertical central axis of the chamber and can withstand high operating temperatures sufficient to at least partially melt metalliferous feed materials.

The HIsarna process is a two-step countercurrent process. Metalliferous feed material is heated and partially reduced by outgoing reaction gases from the smelting vessel (with oxygen-containing gas addition) and flows downwardly into the smelting vessel and is smelted to molten iron in smelting chamber of the smelting vessel. In a general sense, this countercurrent arrangement increases productivity and energy efficiency.

The term "forehearth" is understood herein to mean a chamber of a smelting vessel that is open to the atmosphere and is connected to a smelting chamber of the smelting vessel via a passageway (referred to herein as a "forehearth connection") and, under standard operating conditions, contains molten metal in the chamber, with the forehearth connection being completely filled with molten metal.

International publication WO 00/01854 in the name of the applicant describes that a direct smelting vessel that is an example of a vessel that can be used in the HIsmelt and the HIsarna processes and comprises a hearth formed of refractory material and side walls extending upwardly from the sides of the hearth, with the side walls including water cooled panels, and a forehearth connected to the smelting chamber via a forehearth connection that allows continuous metal product outflow from the vessels. The disclosure in the International publication is incorporated herein by cross-reference.

The HIsmelt and the HIsarna processes are highly agitated and this results in refractory wear of the upper part of the hearth due to chemical attack and physical wear by molten slag and molten metal washing and splashing against the refractory material in the upper part of the hearth. This wear is greater than is typically experienced in the hearths of blast furnaces in which the hot metal and slag is relatively quiescent.

In order to minimize refractory wear mentioned in the preceding paragraph, International publication WO 2015/081376 in the name of the applicant describes the use of heat pipes positioned in a refractory-lined hearth of a smelting vessel, such as by way of example only a direct smelting vessel for the HIsmelt and HIsarna processes, to significantly reduce refractory wear of the refractory material of the hearth due to contact with molten material in the form of molten slag or molten metal. The heat pipes make it possible to use a wider range of refractory materials in the hearth than was previously the case and obtain operational benefits as a consequence of the wider materials selection.

The term "heat pipe" is understood herein to mean a sealed elongate tube that transfers heat without direct conduction as the main mechanism, using a fluid, such as water, within the tube that has a liquid phase that vaporizes at a hot end of the tube under the conditions in which the hot end is located and forms a vapor phase that condenses at a colder end of the tube to form a liquid phase and thereby releases heat, with the liquid phase flowing from the colder end to the hot end of the tube.

The above description is not to be taken as an admission of the common general knowledge in Australia or elsewhere

SUMMARY OF THE DISCLOSURE

The present invention is concerned with improving the performance of heat pipes of the type described in International publication WO 2015/081376, and noting that the present invention is not confined to these heat pipes. More particularly, the present invention is concerned with minimising the risk of uncontrolled release of heat transfer fluid from heat pipes in a direct smelting vessel that could present operational and safety issues for the smelting vessel. For example, in a situation in which the heat transfer fluid is water, the present invention is concerned with minimising the risk of uncontrolled release of water from heat pipes that could cause generation of large amounts of steam in a smelting vessel, which could present operational and safety issues for the smelting vessel.

The invention was made in the course of development work on the smelting vessel with heat pipes described in International publication WO 2015/081376.

During the course of the development work, the applicant realized that it is important to design heat pipes to cope with the heat pipes unexpectedly failing, for example when the heat pipes burst when the internal pressures and/or temperatures exceed a design limit and the heat pipes fail as a consequence. By way of example, the applicant found that heat pipe failure is a potential issue near the end of the operational design life of a heat pipe when the pipe has been under too much heat load for too long a time period.

In broad terms, the present invention provides a smelting vessel for producing molten metal including a refractory lined hearth that in use is in contact with molten slag or molten metal in the vessel, with the hearth including a plurality of heat pipes positioned in a refractory lining of at least a part of the hearth for cooling at least a part of the refractory lining, with at least one of the heat pipes including (a) a liquid phase of a heat transfer fluid, typically water, in a lower section of the heat pipe and (b) a vapor phase of the heat transfer fluid, typically steam, in an upper section of the heat pipe, and (c) a vent to allow vapour phase to escape from the heat pipe to reduce the pressure or the temperature within the heat pipe when the vapour pressure or the temperature in the heat pipe exceeds a predetermined threshold pressure or temperature.

The vapour pressure or the temperature in the heat pipe exceeding a predetermined threshold pressure or temperature is selected on the basis of being an indication that the heat pipe is no longer working effectively and there is a risk of uncontrolled failure of the heat pipe with potential release of water from the heat pipe into the molten metal or molten slag in the smelting vessel.

The threshold pressure or temperature is selected to cause the vent to open before there is uncontrolled failure of the heat pipe. The predetermined threshold pressure or temperature may be the design limit of pressure and temperature for the heat pipe under standard operational conditions. The predetermined threshold pressure or temperature may be the design limit of pressure or temperature for the heat pipe plus a margin above the design limit.

The vent may be adapted to allow vapour phase and not liquid phase to escape from the heat pipe and to retain the liquid phase in the heat pipe. This is advantageous because the liquid phase is more volatile if it comes into contact with molten metal and molten slag in the smelting vessel and the volatility may have an impact on the operational and safety performance of the smelting vessel. As mentioned above, in a situation in which the heat transfer fluid is water, uncontrolled release of water from heat pipes could cause generation of large amounts of steam in the smelting vessel, which could present operational and safety issues for the smelting vessel. The vent may be adapted to allow vapour phase and not liquid phase to escape from the heat pipe and to retain the liquid phase in the heat pipe by way of example because of the location of the vent in the heat pipe.

The vent may be any suitable opening in the heat pipe that is closed under normal operating conditions in which the heat pipe is operating properly, i.e. below the predetermined threshold pressure or temperature, and opens and allows vapour phase to escape from the heat pipe to reduce the pressure or the temperature within the heat pipe when the pressure or the temperature in the heat pipe exceeds the predetermined threshold pressure or temperature.

The vent may allow vapour phase to escape from the heat pipe into the refractory lining of the hearth of the vessel. The vent may allow vapour phase to escape into the molten slag or molten metal. The vent may allow vapour phase to escape outside the vessel.

The preference for the vent to allow vapour phase and not liquid phase to escape from the heat pipe places a constraint on the location of the vent in the heat pipe to be taken into account in vessel design.

The vent may include a snorkel that extends into the heat pipe and has an open end that is inside the heat pipe and communicates only with the vapour phase (under standard operational conditions) and a closed end that is outside the heat pipe, with the closed end being formed so that in use the closed end opens and allows vapour phase and not liquid phase to escape from the heat pipe to reduce the pressure or the temperature within the heat pipe when the vapour pressure or the temperature in the heat pipe exceeds the predetermined threshold pressure or temperature, and thereby minimise the risk of uncontrolled failure of the heat pipe. Consequently, in this condition, the liquid phase is retained in the heat pipe or vaporises progressively and is vented from the heat pipe.

The closed end of the snorkel may be in the form of a plug that opens or a fuse that melts when the vapour pressure or the temperature in the heat pipe exceeds the predetermined threshold pressure or temperature. The invention is not confined to these options for forming the closed end and extends to any option that opens in response to the temperature or the pressure within the heat pipe exceeding the predetermined threshold. By way of example, the closed end of the snorkel may be formed as a cold weld pinch of the end of the snorkel that opens when the temperature or the pressure within the heat pipe exceeding the predetermined threshold.

The heat pipe may be in the form of an elongate hollow tube that contains the liquid phase in a lower section of the tube and the vapor phase in an upper section of the tube.

The heat pipe may include a lower end wall.

The heat pipe may include an upper send wall.

The heat pipe may include a side wall.

The vent may be in the side wall above the level of the liquid phase in the heat pipe.

The vent may be in the top wall of the heat pipe.

The snorkel may extend through the lower end wall. The snorkel may extend through the side wall below the level of the liquid phase in the heat pipe. With both arrangements, as described above, the open end of the snorkel is inside the heat pipe and communicates only with the vapour phase (under standard operational conditions) and the closed end is outside the heat pipe.

The heat pipes may be positioned so that they do not extend out of the smelting vessel.

The refractory lined hearth may include an upper part that in use is in contact with molten slag in a slag zone in the vessel and a lower part that in use is in contact with molten metal in a metal zone in the vessel.

The heat pipes may be positioned in the refractory lining of the upper part of the hearth for cooling the refractory lining.

The heat pipes may be any suitable shape.

The heat pipes may include lower sections that are arranged to extend vertically in the refractory lining.

The lower sections may be straight sections.

The lower sections may be shaped, for example curved, having regard to the geometry of the hearth.

The lower sections of the heat pipes may be parallel to each other.

The lower sections of the heat pipes may be spaced apart from each other.

The spacing of the lower sections of the heat pipes may be the same.

The spacing of the lower sections of the heat pipes may be different.

The spacing of the lower sections of the heat pipes may be the same in one section of the hearth and different in another section of the hearth.

For example, there may be relatively more heat pipes in areas that need more cooling. By way of example, a slag drain tap hole area may require additional cooling.

There are a number of factors that are relevant to the selection of the spacing of the heat pipes including, by way of example, the positions of the heat pipes, the amount of heat to be extracted from the refractory material, the thermal conductivity and other relevant characteristics of the refractory material, and the thermal conductivity of the heat pipes.

The heat pipes may be positioned completely around the hearth.

The heat pipes may be positioned in a ring completely around the hearth.

The heat pipes may be positioned in a plurality of radially spaced-apart rings completely around the hearth.

The heat pipes of one ring may be staggered circumferentially with respect to the heat pipes of a radially outward or radially inward ring.

The heat pipes may be the same length.

The heat pipes may be different lengths.

The length of the heat pipes may increase with radial spacing of the heat pipes from an inner surface of the hearth in which the heat pipes are located.

The refractory lining of the hearth in which the heat pipes are located may have a cylindrical inner surface prior to the commencement of a smelting campaign in the vessel.

The vessel may include a slag zone cooler positioned in the refractory lining of the hearth for cooling the refractory lining, with the heat pipes being positioned below the slag zone cooler, with upper sections of the heat pipes being in heat transfer relationship with the slag zone cooler for transferring heat from the heat pipes to the slag zone cooler.

The slag zone cooler may be of the type described in International publication WO 2007/134382 in the name of the applicant.

The slag zone cooler may be formed as a ring by a plurality of cooler elements.

Each cooler element may be shaped as a segment of the ring, with the side walls extending radially of the ring.

Each cooler element may comprise a hollow open backed cast shell structure having a base wall, a pair of side walls, a front wall and a top wall formed integrally in the cast shell structure and incorporating coolant flow passages for flow of coolant therethrough.

The heat pipes may include upper sections that are arranged to extend radially in the vicinity of the slag zone cooler to maximize heat transfer to the slag zone cooler.

By way of example, the heat pipes may be generally upside-down L-shaped or hockey-stick shaped with vertically extending lower sections and radially or generally radially extending upper sections.

The vessel may include side walls extending upwardly from the hearth and a plurality of cooling panels positioned around the side walls so as to form an interior lining on those side walls.

The vessel may include a device for tapping molten metal and a device for tapping slag from the vessel, one or more than one lance for supplying solid feed materials including solid metalliferous material and/or carbonaceous material into the vessel, and one or more than one lance for supplying an oxygen-containing gas into the vessel to post-combust gaseous reaction products generated in the direct smelting process.

The device for tapping molten metal may be a forehearth.

The vessel may include a smelt cyclone for partially reducing and partially melting solid metalliferous material for the vessel positioned above the vessel.

The vessel may be adapted, by way of example, for producing iron-containing alloys by a molten bath-based direct smelting process.

According to the invention there is provided an assembly of (a) a slag zone cooler element for cooling a part of a refractory lining of a hearth of a smelting vessel and (b) heat pipes in heat transfer relationship with the slag zone cooler for transferring heat from the heat pipes to the slag zone cooler, with at least one of the heat pipes including (i) a liquid phase of a heat transfer fluid, typically water, in a lower section of the heat pipe and (ii) a vapor phase of the heat transfer fluid, typically steam, in an upper section of the heat pipe, and (iii) a vent to allow vapour phase to escape from the heat pipe to reduce the pressure or the temperature within the heat pipe when the vapour pressure or the temperature in the heat pipe exceeds a predetermined threshold pressure or temperature.

The vent may be as described above.

In use, a plurality of the assemblies may be formed as a ring within the hearth of the smelting vessel.

Each cooler element may be shaped as a segment of the ring, with the side walls extending radially.

Each cooler element may comprise a hollow open backed cast shell structure having a base wall, a pair of side walls, a front wall and a top wall formed integrally in the cast shell structure and incorporating coolant flow passages for flow of coolant therethrough.

According to the invention there is provided a smelting vessel for producing molten metal including a refractory lined hearth having an upper part that in use is in contact with slag in a slag zone in the vessel and a lower part that in use is in contact with molten metal in a metal zone in the vessel, the hearth including (a) a slag zone cooler positioned in a refractory lining of the upper part of the hearth for cooling the refractory lining and (b) a plurality of heat pipes positioned in the refractory lining of the upper part of the hearth below the slag zone cooler for cooling the refractory lining, with upper sections of the heat pipes being in heat transfer relationship with the slag zone cooler for transferring heat from the heat pipes to the slag zone cooler and lower sections extending downwardly within the upper part of the hearth from the slag zone cooler, and with at least one of the heat pipes including (i) a liquid phase of a heat transfer fluid, typically water, in a lower section of the heat pipe and (ii) a vapor phase of the heat transfer fluid, typically steam, in an upper section of the heat pipe, and (iii) a vent to allow vapour phase to escape from the heat pipe to reduce the pressure or the temperature within the heat pipe when the vapour pressure or the temperature in the heat pipe exceeds a predetermined threshold pressure or temperature.

The vent may be as described above.

The slag zone cooler and the heat pipes may be formed as an assembly of these two components.

According to the invention there is provided a process for smelting a metalliferous feed material including smelting the metalliferous feed material in a molten bath in the above-described smelting vessel.

The process may include (a) at least partially reducing and partially melting the metalliferous feed material in a smelt cyclone and (b) completely smelting the at least partially reduced/melted material in the molten bath of the above-described smelting vessel.

The metalliferous feed material may be any material that contains metal oxides.

The metalliferous feed material may be ores, partly reduced ores and metal containing waste streams.

The metalliferous feed material may be an iron-containing feed material, such as an iron ore. In that event, the process may be characterised by maintaining a temperature of at least 1100° C., typically at least 1200° C. in the smelt cyclone.

The metalliferous feed material may be a titania slag.

The metalliferous feed material may be a copper-containing feed material.

The process may include maintaining the oxygen potential in the smelt cyclone that is sufficient so that the offgas from the smelt cyclone has a post combustion degree of at least 80%.

According to the present invention there is also provided an apparatus for smelting metalliferous feed material that includes the above-described smelting vessel.

BRIEF DESCRIPTION OF THE DRAWINGS

The present invention is described further by way of example with reference to the accompanying drawings, of which.

DESCRIPTION OF EMBODIMENTS

The invention is relevant to the direct smelting vessels that are used in HIsarna and HIsmelt plants. The invention is not confined to direct smelting vessels used in these plants and is relevant to any suitable direct smelting vessel that contains a molten bath that includes a molten metal layer and a molten slag layer and has a refractory material-lined hearth that requires cooling to maximise the operational life of the hearth, more specifically to reduce refractory wear of the refractory material of the hearth due to contact with molten material in the form of molten slag or molten metal.

The Figures show a part of a direct smelting vessel 4 that is in accordance with an embodiment of the invention. The smelting vessel 4 is suitable for HIsarna and HIsmelt plants and is of the type disclosed in the above-mentioned International publication WO 2015/081376 in the name of the applicant. The smelting vessel 4 comprises a hearth generally identified by the numeral 9 in FIG. 1 that is formed of refractory material and side walls 11 extending upwardly from the sides of the hearth, with the side walls 11 including water cooled panels. The disclosure in the International publication is incorporated herein by cross-reference.

Figure 1:
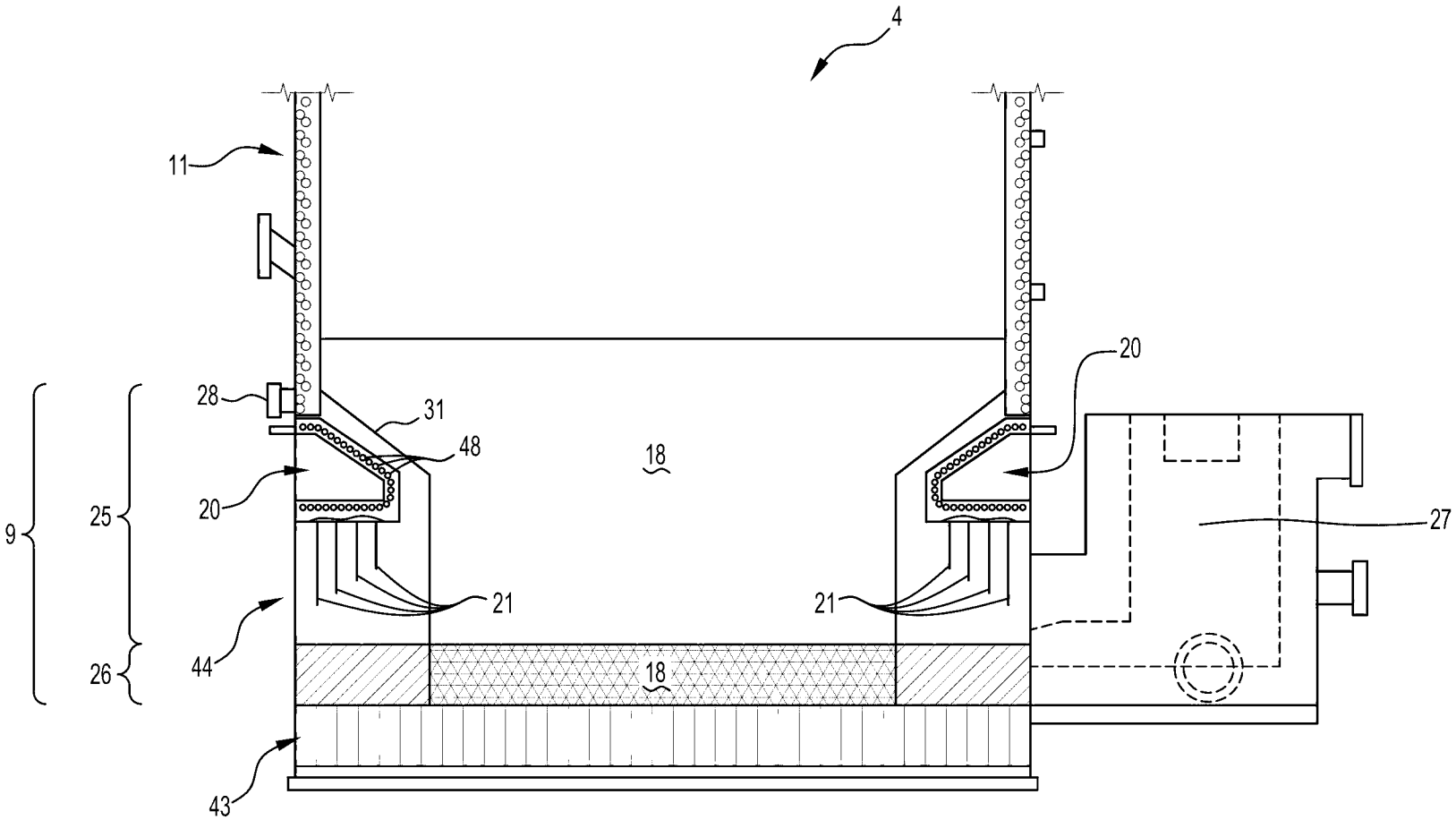
FIG. 1 is an enlargement of a lower section of part of an embodiment of a direct smelting vessel in accordance with the invention prior to the commencement of a direct smelting process in the vessel, with the Figure including the levels of molten metal and molten slag that would be in the vessel under steady state operation of the process, with the levels shown under quiescent, i.e. non-operating, conditions in the vessel.

FIG. 1 is an enlargement of a lower section of part of the smelting vessel 4 prior to the commencement of a direct smelting process in the vessel.

With reference to FIG. 1, the hearth 9 has an upper part 25 that in use is in contact with molten slag in the slag zone 18 in the smelting vessel 4 and a lower part 26 that in use is in contact with molten metal in the metal zone 19 in the smelting vessel 4. The slag zone 18 and the metal zone 19 are shown under quiescent, i.e. non-operating, conditions. It is well understood that the slag and metal zones would be highly agitated under steady state operation of the HIsarna and HIsmelt processes and agitated to a lesser extent under steady state operation of other molten bath-based direct smelting processes.

With further reference to FIG. 1, the hearth 9 includes a base 43 and sides 44 that include a refractory lining in the form of refractory bricks, a forehearth 27 for discharging molten metal continuously and a tap hole 28 for discharging molten slag. An upper annular surface 31 of the hearth tapers upwardly and outwardly to the side wall 11 of the smelting vessel 4. In use of the vessel, this part of the hearth is exposed to splashing with molten metal and slag.

With further reference to FIG. 1, the hearth 9 includes:

(a) a slag zone cooler 20 positioned in the refractory lining of the upper part of the hearth 9 for cooling the refractory lining in that part of the hearth; and (b) a plurality of heat pipes 21 positioned in the refractory lining of the upper part of the hearth below the slag zone cooler 20 for cooling the refractory lining in that part of the hearth.

Figure 2:
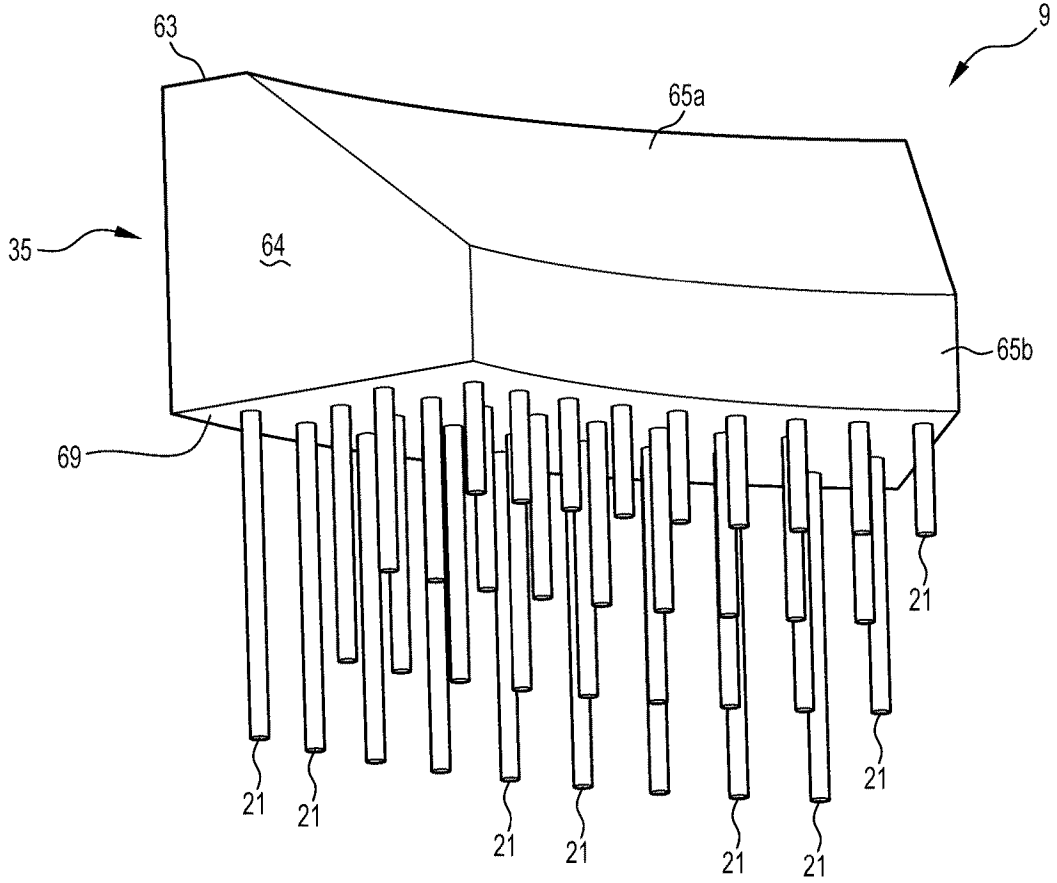
FIG. 2 is a schematic perspective view that illustrates a segment of an upper part of the hearth of the vessel shown in FIG. 1 with the refractory material removed to show the slag zone cooler and the heat pipes of the embodiment.
Figure 4:
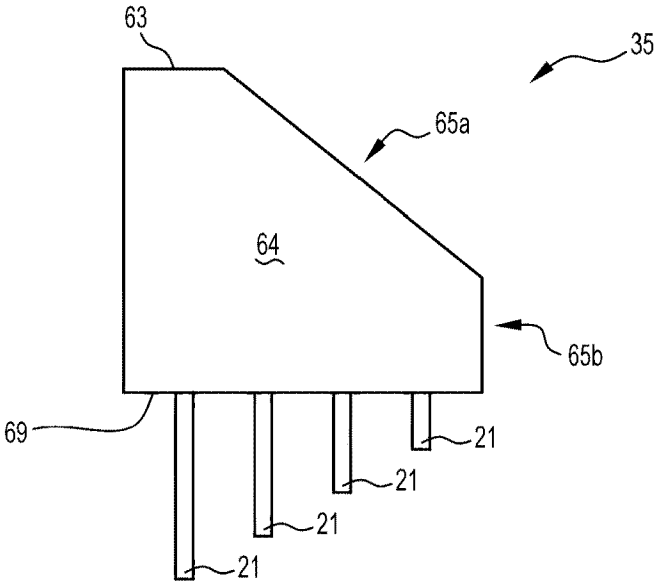
FIG. 4 is an end view of the arrangement shown in FIG. 2.
Figure 3:
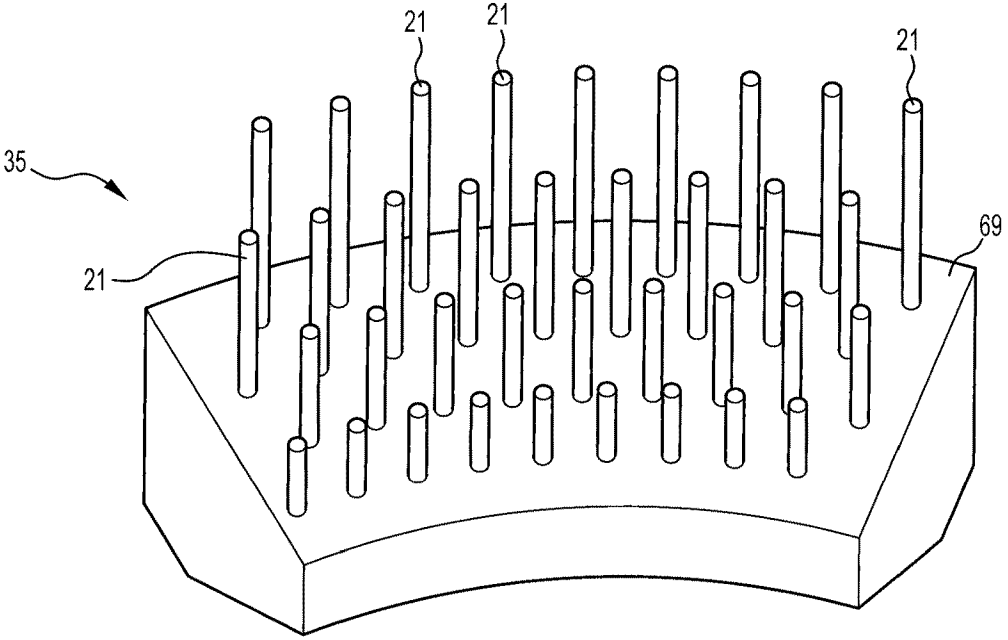
FIG. 3 is an underside view of the arrangement shown in FIG. 2.

The slag zone cooler 20 is as described in International publication WO 2007/134382 in the name of the applicant and the disclosure in the International publication is incorporated herein by cross-reference. The slag zone cooler 20 is formed as a ring by a plurality of cooler elements 35, one of which is shown in FIGS. 2-4. Each cooler element 35 is shaped as a segment of the ring, with the side walls extending radially of the ring. Each cooler element 35 comprises a hollow open backed cast shell structure 41 having a bottom wall 69, a pair of side walls 64, a two-part front wall 65*a*, 65*b*, a bottom wall 49, and a top wall 63 formed integrally in the cast shell structure 41 and incorporating coolant flow passages in the form of tubes 48 (FIG. 1 only), for flow of coolant therethrough. The cast shell structure 41 is made from a metal or metal alloy of high thermal conductivity, such as copper or copper alloy. The coolant tubes are formed from copper or nickel.

Each slag zone cooler element 35 and the associated heat pipes 21 in heat transfer relationship with the slag zone cooler element 35 may be formed as an assembly that can be installed as an assembly on-site. Alternatively, the slag zone cooler elements 35 and the heat pipes 21 may be separately installed on site.

The refractory lining of the upper part 25 of the hearth is efficiently cooled and supported by the slag zone cooler 20. The slag zone cooler 20 significantly reduces the rate of wear of the refractory material in this part of the hearth. In particular, operation of the slag zone cooler 20 cools the refractory lining to below the solidus temperature of the molten slag in the region of the lining and causes slag to freeze onto its surface, and the frozen slag provides a barrier to further wearing of the refractory material.

As is described in International publication WO 2015/081376 and in more detail below, in use, the heat pipes 21 significantly reduce refractory wear of the refractory material of the hearth 9 due to contact with molten material in the form of molten slag or molten metal and make it possible to use a wider range of refractory materials in the hearth 9 than was previously the case and obtain operational benefits as a consequence of the wider materials selection. The heat pipes 21 are positioned so that they do not extend out of the smelting vessel 4. Each heat pipe 21 includes a section that extends vertically. The result is an arrangement of parallel straight vertically extending pipe sections in the refractory lining.

Figure 5:
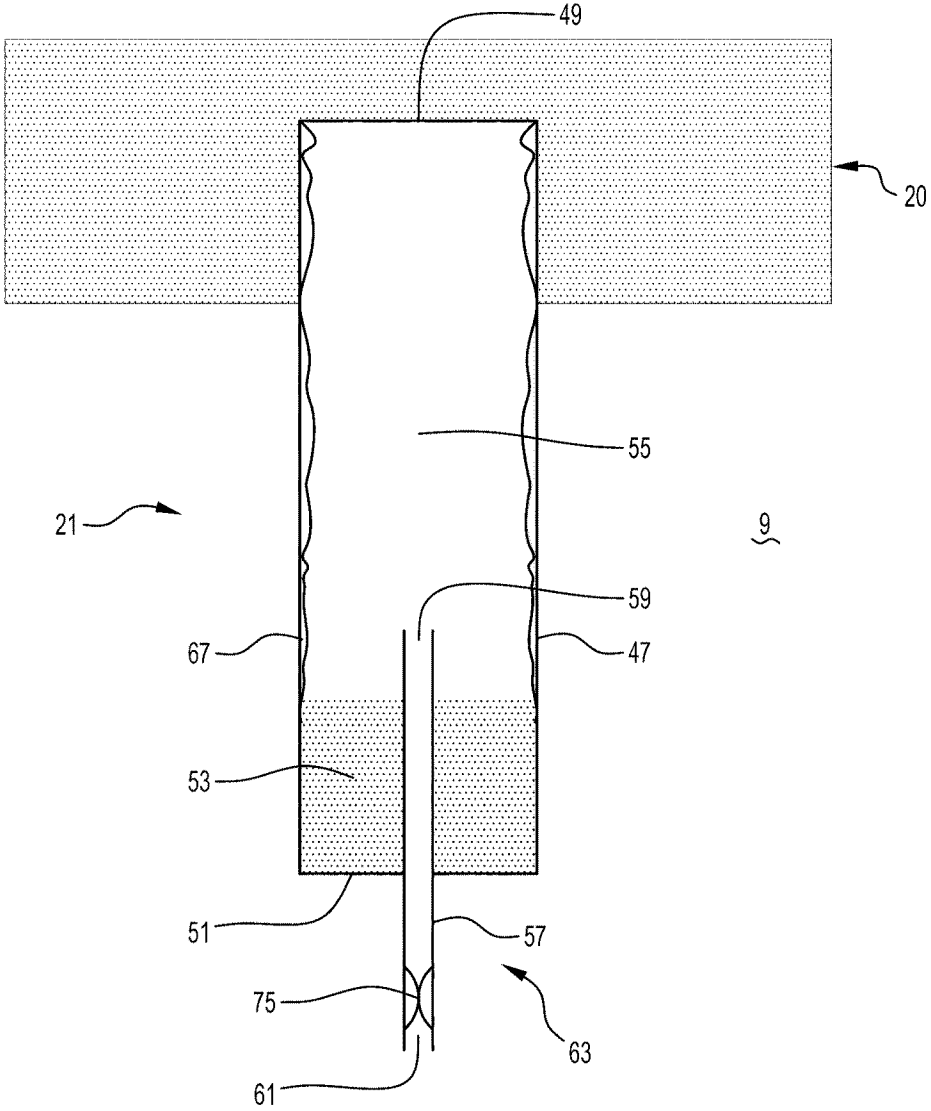
FIG. 5 is a schematic cross-section though one of the heat pipes shown in FIGS. 1 to 4 which illustrates the vent of the heat pipe in detail.

As can best be seen in FIG. 5, each heat pipe 21 is an elongate hollow tube that has a side wall 47, and upper end wall 49, and a lower end wall 51. The tube contains (a) mainly water 53 in a lower section of the tube and (b) mainly steam 55 in an upper section of the tube.

The heat pipes 21 extend downwardly vertically and parallel to each other within the upper part of the hearth 9 from the slag zone cooler 20. In use, the heat pipes 21 cool the refractory lining of the upper part of the hearth that is below the slag zone cooler 20. The upper sections of the heat pipes 21 are in heat transfer relationship with the slag zone cooler 20 and transfer heat from the heat pipes 21 to the slag zone cooler 20. In use, there is vaporization of the water phase and condensation of the vapor phase in response to heat transfer from the refractory lining to the heat pipes 21 and heat transfer from the heat pipes 21 to the slag zone cooler 20. Each heat pipe 21 transfers heat without direct conduction as the main mechanism, with the water vaporizing at a hot lower end and condensing and forming water at a colder upper end. The condensation of the vapor releases heat which is transferred to the slag zone cooler 20. With reference to FIG. 5, the condensed water flows downwardly and returns to the hot lower end to close the internal cooling circuit. For example, the condensed water may form a film, typically a thin film, on the inside surface of side wall 47 that flows downwardly to the hot lower end. The thin film layer is identified by the numeral 67 in FIG. 5.

Typically, the heat pipes 21 are positioned all of the way around the hearth. The heat pipes 21 are arranged in four radially-spaced apart rings in the embodiment shown in FIGS. 1 to 4. This arrangement can best be seen in FIG. 2. The heat pipes 21 in each ring are staggered circumferentially with respect to the heat pipes 21 in the radially inward and radially outward rings of heat pipes 21. The length of the heat pipes 21 increases with radial spacing of the heat pipes 21 from an inner surface of the upper part 25 of the hearth in which the heat pipes are located. The heat pipes 21 may be in any other suitable arrangement and orientation. By way of example, the invention is not confined to arrangements in which the heat pipes 21 are vertical. By way of further example, the invention is not confined to arrangements in which the heat pipes 21 are straight—the heat pipes 21 may include curved sections to accommodate structural features of the hearth. By way of further example, the invention is not confined to arrangements in which the length of the heat pipes 21 increases with radial spacing of the heat pipes 21 from the inner surface of the upper part 25 of the hearth.

The heat pipes 21 may be of any suitable construction.

Typically, the heat pipes 21 contain water. Any other suitable heat transfer fluid at the operating temperature of the process may be used, such as alcohol, acetone or even metal as sodium. The heat pipes 21 remove heat from the refractory material of the refractory lining and any protective solidified material (slag or metal) that forms on an inner surface of the refractory lining. The objective of the heat pipes 21 is to maintain as large as possible a volume of the refractory material of the refractory lining in which the heat pipes 21 are positioned below the solidus temperature of the slag in the region of the refractory lining to cause slag (or metal) to freeze onto the surface of the hearth and form a frozen slag (or metal) layer that acts as a barrier to wear.

With reference to FIG. 5, at least one of the heat pipes 21 includes a vent generally identified by the numeral 63 that allows steam and not water to escape from the heat pipe 21 when the pressure or temperature in the heat pipe exceeds a predetermined threshold—which is an indication that the heat pipe 21 is no longer working effectively and there is a risk of uncontrolled failure of the heat pipe 21 with potential release of water from the heat pipe 21 into the molten metal or molten slag in the smelting vessel.

With further reference to FIG. 5, the vent includes a snorkel 57 in the form of an elongate tube that extends into the heat pipe 21 through the lower end wall 51 and has an open end 59 that is inside the heat pipe 21 and communicates only with the steam 55 in the heat pipe 21 and a closed end 61 that is outside the heat pipe 21 and is located within the refractory lining of the hearth 9. The closed end 61 of the snorkel 57 is formed via a plug (fuse) 75 of suitable material that blocks the end. The closed end 61 is formed to open when the vapour pressure or the temperature in the heat pipe 21 exceeds a predetermined threshold pressure or temperature. When the snorkel 57 is open, steam can escape from the heat pipe 21 via the snorkel 57 to reduce the pressure and the temperature within the heat pipe 21 and thereby minimise the risk of uncontrolled failure of the heat pipe 21. Consequently, in this condition, the liquid water is initially retained in the heat pipe 21 until it gradually evaporates by the continuous incoming heat flow. The steam escapes via the snorkel 57 into the refractory lining of the hearth 9.

With further reference to FIG. 5, it can be seen that the snorkel 57 includes a section within the heat pipe 21 and a section that is external to the heat pipe 21. The selection of these lengths of snorkel 57 inside and outside the heat pipe 21 and the selection of the inside diameter of the snorkel 57 is a function of a number of factors including the size of the heat pipe 21 and the amount of heat transfer fluid in the heat pipe 21 and the operational conditions in which the heat pipe 21 is located.

The vent advantageously results in a reduced risk of liquid water escaping from the heat pipe 21 and producing sudden vapour volume. This is advantageous in terms of reducing the risk of water coming into contact with molten metal and molten slag in the smelting vessel, thereby creating an uncontrolled event in the smelting vessel 4, such as a problematic explosion or uncontrollable pressure excursion. The snorkel 57 allows vapour and not liquid to escape directly from the heat pipe 21 when the threshold pressure and temperature is exceeded.

The threshold pressure and temperature may be any suitable value having regard to the construction of the heat pipe 21 and the operational conditions (including required heat loads) on the heat pipes 21. The predetermined threshold pressure or temperature may be the design limit of pressure and temperature for the heat pipe under standard operational conditions. The predetermined threshold pressure or temperature may be the design limit of pressure or temperature for the heat pipe plus a margin above the design limit. By way of example, in the case of an HIsmelt or an HIsarna process smelting metalliferous feed material in the form of iron ore, typically the construction of the heat pipe 21 is such that the heat pipe 21 will burst, i.e. fail in an uncontrolled way, at temperatures of ~270° C. within the heat pipe 21. In this situation, the threshold temperature would be selected to be lower than 270° C. so that the snorkel 57 opens and allows steam to vent from the snorkel before the heat pipe reaches the failure temperature.

The applicant has carried out laboratory testing of the invention. Specifically, two heat pipes with snorkel vents 57 of the type described in the Figures were fabricated, as follows and then tested as described below.

Fabrication

- Heat pipes: ¾ outer diameter (OD) and 24.5" length formed from monel containing 30 g (~25% of internal volume) water as the heat transfer fluid.
- Snorkels: tube sizes of ⅛" OD and 1/16" OD, respectively, formed from copper and vacuum brazed to the heat pipes, with snorkel length of ~22" within the heat pipes and snorkel length of 6-7" outside the heat pipes.
- The ends of the snorkels were closed by pinching the ends and cold welding the pinched ends.

Test Setup Description

- Heat was supplied to the bottom 3" of the heat pipes.
- Heat was rejected from the heat pipes by natural convection and radiation over the exposed length of the heat pipes (~21.5").
- Thermocouples were spot welded to the heat pipe surfaces.
- Constant Heat Input Test: applied a constant 450 W to the heat pipes and monitored temperature at which snorkel released vapour.
- Temperature Soak Test: used a temperature controller to vary the operating temperature of the heat pipes in a step-wise manner.
- Maintained each temperature set point for ~30 min to determine if snorkel release is time/temperature dependent.

Results

- Prior to cold-weld pinch failure, both heat pipes demonstrated proper heat pipe operation, indicated by isothermal temperatures across each pipe surface.
- For all tests, the water remained in the vapour (or steam) state while venting from the snorkels.
- The test results showed that the snorkels could vent the heat pipes safely with steam release only.

Many modifications may be made to the embodiment of the process of the present invention described above without departing from the spirit and scope of the invention.

By way of example, whilst the embodiments include vents in the form of snorkels 57 that allows steam and not water to escape from the heat pipes 21 when the pressure or temperature in the heat pipes exceeds a predetermined threshold, the present invention is not limited to snorkels and extends to any suitable vent construction.

By way of example, whilst the embodiments include snorkels 57 having closed ends formed as a plug (fuse) 75 of suitable material that blocks the end, the present invention is not so limited and extends to any suitable option for closing the ends of snorkels. The requirement is to provide a closure that is responsive to the selected threshold pressure or temperature in the heat pipe. The threshold pressure or temperature is selected to cause the vent to open before there is uncontrolled failure of the heat pipe failure of the heat pipe.

By way of example, whilst the embodiments include arrangements of heat pipes 21 in which the lengths of the heat pipes 21 increase with radial spacing of the heat pipes 21 from an inner surface of the upper part of the hearth in which the heat pipes are located, the present invention is not so limited and the heat pipes 21 may be of any suitable length.

By way of example, whilst the embodiments include a slag zone cooler 20, the present invention is not so limited and extends to arrangements in which there are no slag zone coolers 20. It is noted that slag zone coolers 20 of the type shown in the embodiments are a convenient option to facilitate heat transfer from the heat pipes 21 to outside the vessel 4.

By way of example, whilst the embodiments focus on contact of refractory linings with molten slag, the present invention is not so limited and also extends to situations where refractory linings are contacted by molten metal.

The invention claimed is:

1. A smelting vessel for producing molten metal including a refractory lined hearth that in use is in contact with molten slag or molten metal in the vessel, with the hearth including a plurality of heat pipes positioned in a refractory lining of at least a part of the hearth for cooling at least a part of the refractory lining, with at least one of the heat pipes including:

- a liquid phase of a heat transfer fluid, in a lower section of the heat pipe;
- a vapour phase of the heat transfer fluid, in an upper section above a first section of the heat pipe;
- and
- a snorkel extending into the heat pipe through a vent defined in the heat pipe, the snorkel comprising:
  - an open end, that is inside the heat pipe and adapted to communicate with the vapour phase, and a closed end, that is outside the heat pipe, wherein, the closed end of the snorkel is in the form of a plug that opens or a fuse that melts or a crimped end that is configured to open when the vapour pressure or the temperature in the heat pipe exceeds a predetermined threshold pressure or temperature, to allow the vapour phase and not the liquid phase to escape from the heat pipe to reduce the pressure or the temperature within the heat pipe.

2. The vessel defined in claim 1, wherein the snorkel is adapted to allow vapour phase rather than the liquid phase to escape from the heat pipe and to retain the liquid phase in the heat pipe.

3. The vessel defined in claim 1, wherein the hearth includes an upper part that in use is in contact with molten slag in a slag zone in the vessel and a lower part that in use is in contact with molten metal in a metal zone in the vessel, with the heat pipes being positioned in the refractory lining of the upper part of the hearth for cooling the refractory lining.

4. The vessel defined in claim 1, wherein the heat pipes include lower sections that extend vertically in the refractory lining.

5. The vessel defined in claim 4, wherein the lower sections of the heat pipes are straight sections.

6. The vessel defined in claim 4, wherein the lower sections of the heat pipes are curved shaped, having regard to the geometry of the hearth.

7. The vessel defined in claim 1, further comprising a slag zone cooler positioned in the refractory lining of the hearth for cooling the refractory lining, with the heat pipes being positioned below the slag zone cooler, with upper sections of the heat pipes being in heat transfer relationship with the slag zone cooler for transferring heat from the heat pipes to the slag zone cooler.

8. An assembly of (a) a slag zone cooler element for cooling a part of a refractory lining of a hearth of a smelting vessel and (b) heat pipes in heat transfer relationship with the slag zone cooler for transferring heat from the heat pipes to the slag zone cooler, with at least one of the heat pipes adapted to include (i) a liquid phase of a heat transfer fluid, in a lower section of the heat pipe and (ii) a vapour phase of the heat transfer fluid, in an upper section of the heat pipe, and (iii) a snorkel extending into the heat pipe through a vent defined in the heat pipe, the snorkel comprising:

an open end, that is inside the heat pipe, and a closed end, that is outside the heat pipe, wherein, the closed end of the snorkel is in the form of a plug that opens or a fuse that melts or a crimped end that is configured to open when the vapour pressure or the temperature in the heat pipe exceeds a predetermined threshold pressure or temperature, to allow the vapour phase to escape from the heat pipe to reduce the pressure or the temperature within the heat pipe.

9. A smelting vessel for producing molten metal including a refractory lined hearth having an upper part that in use is in contact with slag in a slag zone in the vessel and a lower part that in use is in contact with molten metal in a metal zone in the vessel, the hearth including (a) a slag zone cooler positioned in a refractory lining of the upper part of the hearth for cooling the refractory lining and (b) a plurality of heat pipes positioned in the refractory lining of the upper part of the hearth below the slag zone cooler for cooling the refractory lining, with upper sections of the heat pipes being in heat transfer relationship with the slag zone cooler for transferring heat from the heat pipes to the slag zone cooler and lower sections extending downwardly within the upper part of the hearth from the slag zone cooler, and with at least one of the heat pipes including (i) a liquid phase of a heat transfer fluid, in a lower section of the heat pipe and (ii) a vapour phase of the heat transfer fluid, in an upper section above the lower section of the heat pipe, and (iii) a snorkel extending into the heat pipe through a vent defined in the heat pipe, the snorkel comprising:

an open end, that is inside the heat pipe in communication with the second section of the heat pipe, and a closed end, that is outside the heat pipe, wherein, the closed end of the snorkel in the form of a plug that opens or a fuse that melts or a crimped end that is configured to open when the vapour pressure or the temperature in the heat pipe exceeds a predetermined threshold pressure or temperature, to allow the vapour phase to escape from the heat pipe to reduce the pressure or the temperature within the heat pipe.

10. A process for smelting a metalliferous feed material comprising smelting the metalliferous feed material in a molten bath in the smelting vessel defined in claim 1.

11. The process defined in claim 10, further comprising (a) at least partially reducing and partially melting the metalliferous feed material in a smelt cyclone and (b) completely smelting the at least partially reduced/melted material in the molten bath of the smelting vessel.

12. A smelting apparatus for smelting metalliferous feed material, the smelting apparatus comprising:

a smelting vessel for producing molten metal including a refractory lined hearth that in use is in contact with molten slag or molten metal in the vessel, with the hearth including a plurality of heat pipes positioned in a refractory lining of at least a part of the hearth for cooling at least a part of the refractory lining, with at least one of the heat pipes including:

a liquid phase of a heat transfer fluid, in a lower section of the heat pipe;

a vapour phase of the heat transfer fluid, in an upper section above a first section of the heat pipe; and a snorkel extending into the heat pipe through a vent defined in the heat pipe, the snorkel comprising:

an open end, that is inside the heat pipe and adapted to communicate with the vapour phase, and a closed end, that is outside the heat pipe, wherein, the closed end of the snorkel is in the form of a plug that opens or a fuse that melts or a crimped end that is configured to open when the vapour pressure or the temperature in the heat pipe exceeds a predetermined threshold pressure or temperature, to allow the vapour phase and not the liquid phase to escape from the heat pipe to reduce the pressure or the temperature within the heat pipe.

* * * * *